United States Patent [19]

Crocker

[11] 4,387,672

[45] Jun. 14, 1983

[54] ENERGY TRANSFER APPARATUS

[76] Inventor: Alfred J. Crocker, 4906 Naomi Dr., Toledo, Ohio 43623

[21] Appl. No.: 309,824

[22] Filed: Oct. 8, 1981

[51] Int. Cl.[3] ..... F02B 75/22

[52] U.S. Cl. ..... 123/55 AA; 123/56 C

[58] Field of Search ..... 123/43 C, 44 E, 55 R, 123/55 A, 55 AA, 55 SR, 56 R, 56 C

[56] References Cited

U.S. PATENT DOCUMENTS

| | | | |
|---|---|---|---|
| 1,122,972 | 12/1914 | Maye | 123/44 E |
| 1,765,713 | 6/1930 | Boland | 123/55 AA |
| 1,795,865 | 3/1931 | Kettering | 123/55 AA |
| 1,829,780 | 11/1931 | Beytes et al. | 123/55 AA |
| 1,863,877 | 6/1932 | Rightenour | 123/55 SR |

FOREIGN PATENT DOCUMENTS

| | | | |
|---|---|---|---|
| 12336 | of 1910 | United Kingdom | 123/55 AA |

*Primary Examiner*—Craig R. Feinberg

*Attorney, Agent, or Firm*—Wilson, Fraser, Barker & Clemens

[57] ABSTRACT

An apparatus having cylinders arranged radially about a rotatable shaft and a separate piston adapted to reciprocate in each cylinder. Each piston is held in contact with a cam eccentrically mounted on the shaft by means of linkages and rollers. The eccentrically mounted cam produces more complete scavenging of the cylinders and a large volume intake. The cam profile provides greater time for the power portion of the engine cycle than for the exhaust portion of the engine cycle. In a four-cycle apparatus, greater time also is provided for the intake portion of the cycle than for the compression portion of the cycle.

3 Claims, 5 Drawing Figures

ENERGY TRANSFER APPARATUS

BACKGROUND OF THE INVENTION

1. Field of the Invention

This invention generally relates to reciprocating piston mechanisms and more particularly to reciprocating pistons reciprocated by a cam mounted on a rotary shaft by means of cam rollers which are connected to the pistons.

2. Description of the Prior Art

Many energy transfer apparatuses employing cams and reciprocating pistons have been produced in the past. Conventionally, they have been used in internal combustion engines, compressors, and the like.

For example, one type of reciprocating piston internal combustion engine employing cams for operating pistons, is illustrated in the United States Pat. No. 1,765,713. As disclosed therein, cylinders are arranged radially about a drive shaft. Each piston within a cylinder is attached to a roller which is held in contact with a first cam mounted on the drive shaft. Linkages and a second set of rollers riding on a second cam on the drive shaft hold the rollers attached to the pistons in contact with the first cam so that as the pistons reciprocate, the cam is caused to rotate to in turn rotate the drive shaft. In order to maintain the rollers attached to the piston in contact with the cam, the second cam has a different profile from the first cam. A modification of this type of engine is illustrated in U.S. Pat. No. 1,863,877 in which a spring loaded strap extends over sets of rollers to hold the rollers attached to the pistons in contact with the cam. The cam illustrated in this patent has major and minor diameters which are displaced from one another by less than 90° so that the power and intake strokes of the piston occur over 35° of shaft rotation and the compression and exhaust strokes of the pistons occur over 55° of shaft rotation. In the above-described arrangements, the center of the cam is coincident with the center of the drive shaft. Accordingly these arrangements appear to provide less efficiency over conventional engines having a crank shaft for converting reciprocating motion to rotary motion since intake and power portions of the cycle take place over a smaller percentage of the total cycle than the compression and exhaust portions of the cycle. Furthermore, a complicated arrangement is required for holding the piston mounted rollers in contact with the cam.

SUMMARY OF THE INVENTION

According to the present invention, an improved, more efficient energy transfer apparatus is provided of the type including at least one cylinder radially arranged about a rotatable shaft. The cylinder has a reciprocating piston which is attached either directly or through a connecting rod to a roller. The piston connected roller is held in contact with a cam mounted on the drive shaft by means of six equal linkages and rollers which engage the cam. The cam is symmetrical in cross-section in that all diameters have coincident centers and, in accordance with the invention, the centers are displaced from the axis of the rotatable shaft along the major diameter of the cam. This construction produces a complete scavenging of the cylinder during the pistons exhaust stroke and a larger cylinder volume on the pistons intake stroke. Further, the cam is designed with a major diameter and a minor diameter which are displaced from one another by other than 90° so that, in the case of an internal combustion engine, the intake and power strokes of the engine, for a four cycle engine, take place over greater than 90° of shaft rotation and the compression and exhaust strokes take place in less than 90° of shaft rotation to provide greater efficiency in the engine, particularly when the engine is operated at higher speeds with relatively slow burning fuels.

Accordingly, it is an object of the invention to provide an improved, efficient energy transfer apparatus wherein the cylinders are completely scavaged and an incoming charge is large in volume.

Another object of the invention is to produce an energy transfer apparatus with a long intake stroke.

Still another object of the invention is to produce a four cycle energy transfer apparatus with intake and power strokes longer in duration than compression and exhaust strokes.

BRIEF DESCRIPTION OF THE DRAWINGS

The above-mentioned and other features, objects and advantages and a manner of obtaining them are described more specifically below by reference to an embodiment of the invention shown in the accompanying drawings, in which.

DESCRIPTION OF THE PREFERRED EMBODIMENTS

Although the energy transfer apparatus constructed in accordance with the present invention, will be described in conjunction with a reciprocating piston, internal combustion engine, it should be understood that it is adaptable for use in other types of apparatus, such as compressors and the like.

Figure 1:
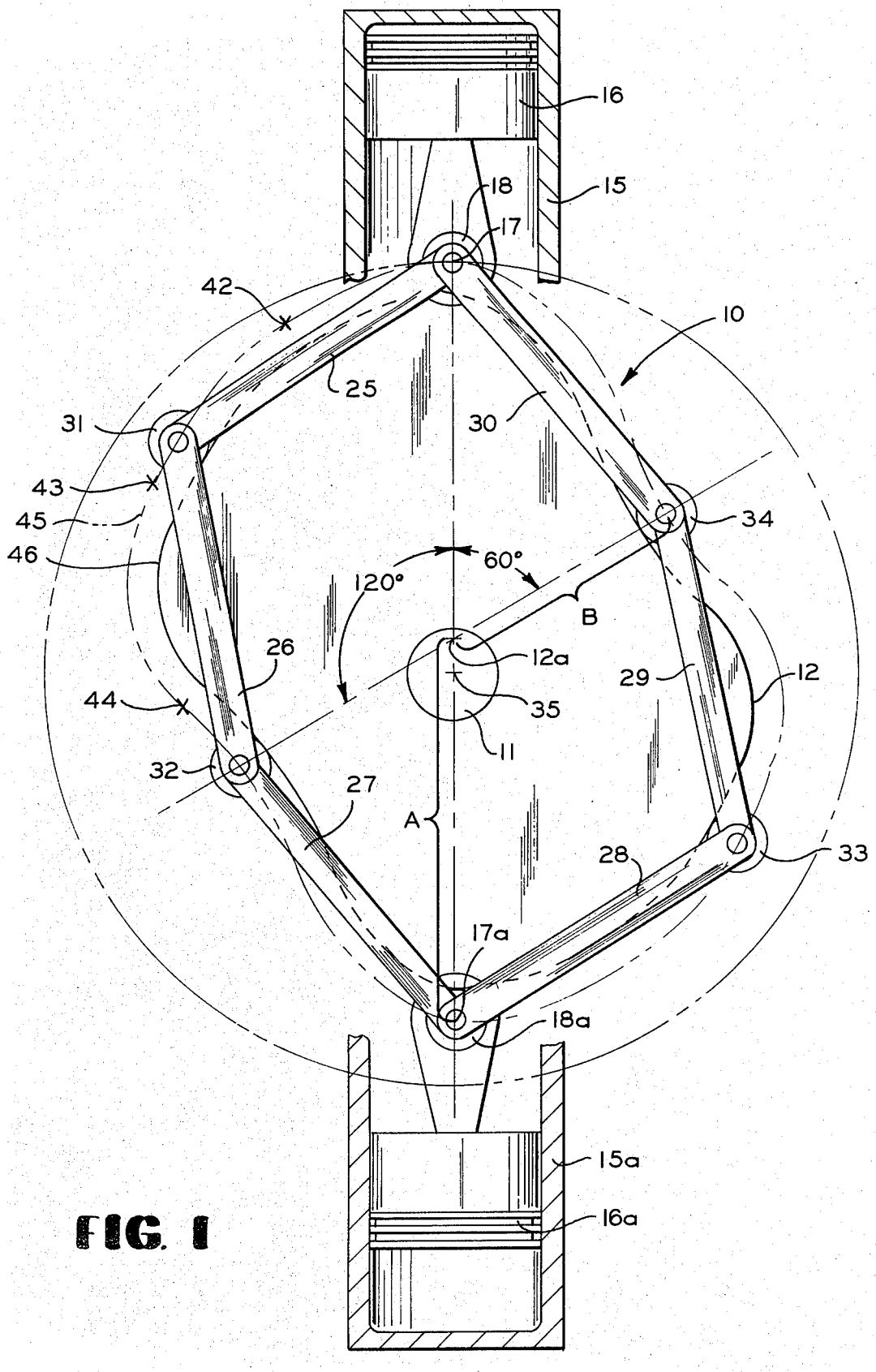
FIG. 1 is a fragmentary diagrammatic view of an energy transfer apparatus constructed in accordance with an embodiment of the invention and showing the cam profile, the linkages and the rollers for converting reciprocating motion to rotary motion.
Figure 2:
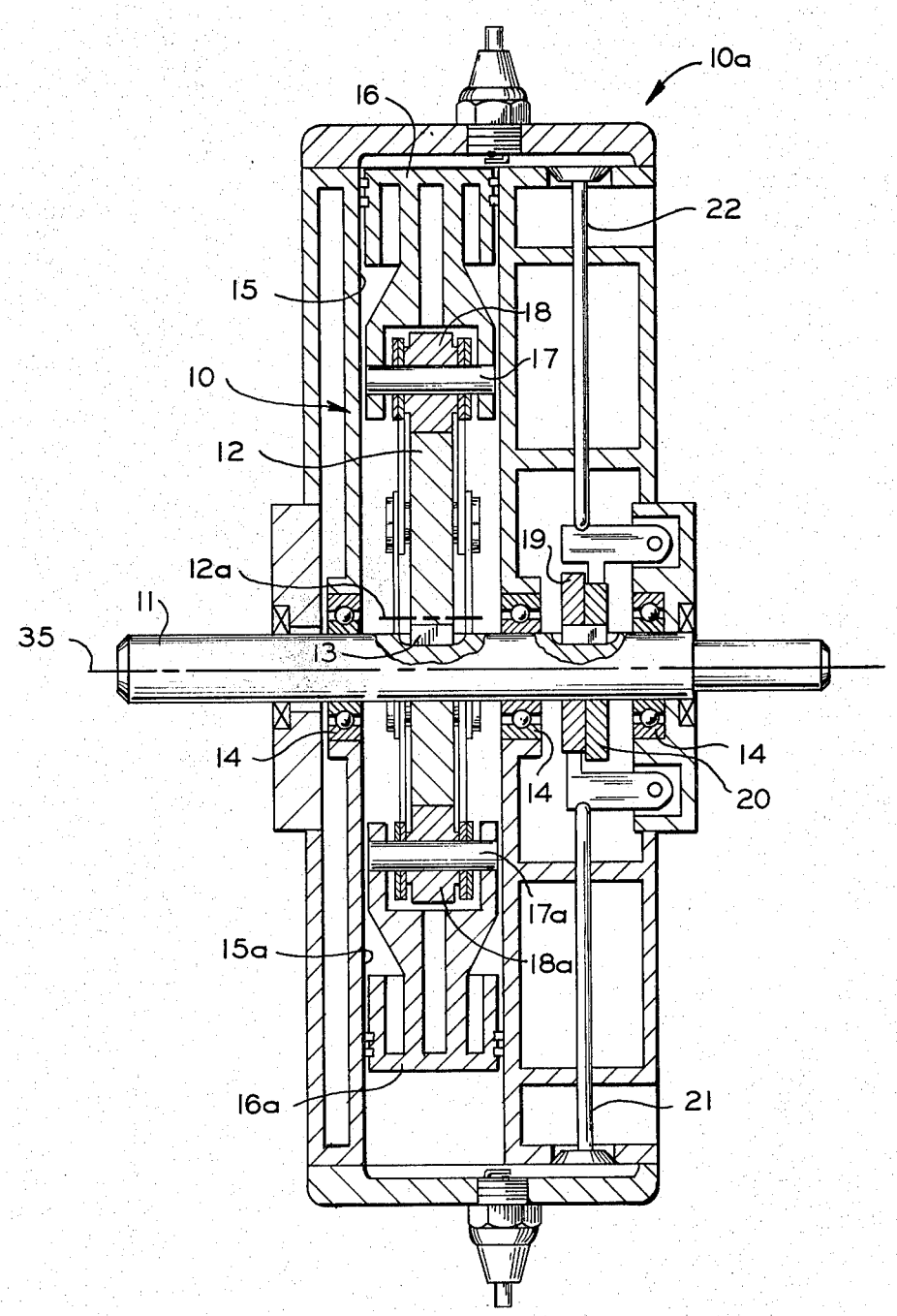
FIG. 2 is a cross-sectional view through a reciprocating piston energy transfer apparatus illustrated in FIG. 1.

Referring now to the drawings and particularly to FIGS. 1 and 2, an energy transfer apparatus 10 is illustrated in conjunction with a reciprocating piston internal combustion engine 10*a*. The engine 10*a* generally includes a drive shaft 11 to which a cam 12 constituting a portion of the energy transfer apparatus 10 is attached by means of a key 13. The shaft 11 and attached cam 12 rotate on a plurality of bearings 14. The engine 10*a* preferably includes at least two cylinders 15 and 15*a* extending radially outwardly from the shaft 11. Each piston 16 and 16*a* is positioned in the cylinders 15 and 15*a*, respectively, for reciprocation towards and away from the shaft 11. Each piston 16 and 16*a* is connected through a pin 17 and 17*a* to a roller 18 and 18*a*, respectively, which ride on the cam 12. For a four cycle engine, as the shaft 11 and cam 12 rotate, the cam 12 forces the pistons 16 and 16*a* outwardly away from the shaft 11 during compression and exhaust strokes and pulls the pistons 16 and 16*a* radially inwardly towards the shaft 11 during the intake stroke. In an internal combustion engine the pistons 16 and 16*a* apply power to rotate the cam 12 during the power stroke. However, in a compressor the cam 12 drives the pistons for causing them to deliver compressed charges of gas, such as air from the cylinders.

The engine 10*a* may be provided with any suitable conventional value arrangement for supplying an air/fuel mixture to the cylinders 15 and 15*a* during the intake stroke of the pistons 16 and 16*a*. In the exemplary engine 10*a* illustrated in FIG. 2, two cams 19 and 20 are provided for operating valves 21 and 22, respectively, for supplying an air/fuel mixture to or exhausting gases from the two cylinders 15 and 15*a*. Of course, the engine 10*a* may be of other designs, such as a diesel engine, in which fuel is injected directly into the cylinder.

Turning now to FIG. 1, a diagrammatic fragmentary portion of the engine 10*a* illustrates the shape and operation of the cam 12 for rotating the shaft 11 and moving the pistons 16 and 16*a*. The upper one of the pistons 16 is shown attached to the roller 18 which rides on the cam 12 and the lower piston 16*a* is shown attached to a roller 18*a* which also rides on the cam 12. The linkages 25 through 30 are each of identical length and adjacent ones of the linkages 25 through 30 are pivotally connected together. The adjacent linkages 25 and 26 are connected together and pivotally attach to an idler roller 31 which rides on the cam 12. Similarly, the adjacent linkages 26 and 27 are pivotally connected together and are connected to an idler roller 32 which rides on the cam 12. The adjacent linkages 28 and 29 are pivotally connected together and are connected to an idler roller 33 which rides on the cam 12 and the adjacent linkages 29 and 30 are pivotally connected together and are connected to an idler roller 34 which rides on the cam 12. The adjacent linkages 25 and 30 are pivotally connected together and are connected to the roller 18 which in turn is connected to the piston 16 and the adjacent linkages 27 and 28 are pivotally connected together and are connected to the roller 18*a* which is connected to the other piston 16*a*. The cam 12 is designed in combination with the linkages 25 through 30 so that, as the cam 12 rotates, each of the rollers 18, 18*a* and 31 through 34 stay in contact with the cam 12.

Figure 3:
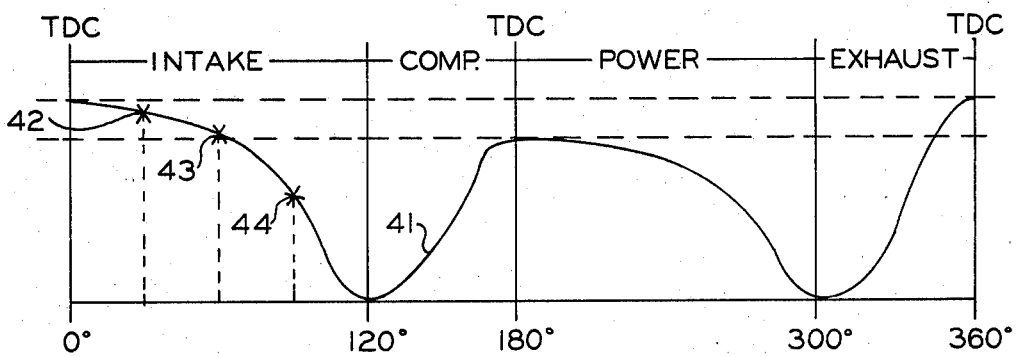
FIG. 3 is a graph illustrating an exemplary cycle of the apparatus of the present invention.

The design of the cam 12 is best illustrated by referring to both FIGS. 1 and 3. The center of the cam 12 is off-set from the axis 35 of rotation of the shaft 11 along the major diameter of the cam. In other words, the axis 35 of rotation of the shaft 11 is positioned along the line of the major diameter of the cam 12 at a desired spacing from the center 12*a*. This arrangement alters the displacement of the pistons 16 and 16*a* in the cylinders 15 and 15*a*, respectively. It will be noted that in this arrangement, the cam 12 is eccentrically mounted on the shaft 11 and must be dynamically balanced for high velocity operation. The cam pattern is provided with a major diameter which is a maximum distance between the axes of any two opposed rollers, such as between the two rollers 18 and 18*a*, as the cam 12 rotates. The cam 12 also has a minor diameter which is a minimum distance between the axes of the two opposed rollers 32 and 34, as illustrated in FIG. 1. The major diameter has a radius length A and the minor diameter has a radius length B, as labelled in FIG. 1. The stroke of each piston 16 and 16*a* is the difference between the major and minor radii A and B. Accordingly, by displacing the center 12*a* of the cam 12 from the axis 35 of rotation for the shaft 11, the displacement of the pistons 16 and 16*a* in the cylinders 15 and 15*a* is altered so as to cause the piston 16 to completely scavenge the cylinder 16 in the exhaust stroke. It will be noted in FIG. 3 that the piston 16*a* causes a larger fuel/air mixture to be drawn into the cylinder 15*a* during the intake stroke and adequately compressed during the compression stroke.

The major and minor radii A and B are displaced from one another by an angle other than 90°. This displacement is in a direction to provide greater time for the intake and power strokes for a four cycle engine than is provided for the compression and exhaust strokes. For example, in the illustrated cam 12, the major and minor radii are spaced apart to provide 120° of shaft rotation for the intake stroke, 60° of shaft rotation for the compression stroke, 120° of shaft rotation for the power stroke and 60° of shaft rotation for the exhaust stroke. This arrangement provides greater efficiency in the engine, particularly at higher engine speeds with relatively slowly burning fuels.

In a reciprocating piston engine, a valve is opened during the intake portion of the cycle and fresh air or an air/fuel mixture is drawn in to the cylinder as the piston moves downwardly in the cylinder. In non-supercharged engines, there is a relatively low pressure differential causing the fresh air or air/fuel mixture to flow into the cylinder during the intake portion of the cycle. By providing a greater time for this portion of the cycle, the engine is more efficiently charged with fresh air or with an air/fuel mixture. This is particularly true at higher engine speeds where very little time is provided for intake. A greater time also is provided during the power portion of the cycle. This greater time interval allows for a release of working pressure over a wider angle of shaft rotation. Furthermore, the additional time for the power portion of the cycle results in a greater pressure on the piston at the end of the power stroke since there is more time for completion of combustion. On the other hand, the time required for the compression and exhaust portion of the cycle is not critical and, by shortening the time for these portions of the cycle, additional time is provided for the intake and power portions of the cycle.

The design of the cam 12 is best illustrated in FIG. 1 and the graph in FIG. 3. In FIG. 3, a line 41 illustrates the position of the piston as the shaft 11 and cam 12 rotate through 120° for the intake stroke, through 60° for the compression stroke, through 120° for the power stroke and finally through 60° for the exhaust stroke of the piston. It should be noted that during the power stroke, the piston initially moves very little to allow pressure buildup which is finally released over the latter part of the stroke. The actual curve for the power stroke is selected to provide desired operating characteristics to the engine.

In designing the pattern for the cam 12, the initial step is to determine a desired displacement for the reciprocating pistons 16 and 16*a*. From this selected displacement, the major radius A and the minor radius B are selected. Several points, points 42 through 44, on the line 41 representing the desired position of the piston versus angular rotation of the cam 12 are marked on the line 41 of the graph of FIG. 3. These points 42 through 44 are used for generating a cam pattern 45 (See FIG. 1) for a portion of the cycle, such as for the illustrated intake portion of the cycle. An actual cam profile 46 is formed from the cam pattern 45 by allowing for the radius of the rollers 18, 18*a*, and 31 through 34. In other words, the cam profile 46 corresponds to the cam pattern 45, only smaller by the radius of the rollers 18, 18*a* and 31 through 34.

The links 25 through 30 are established at a uniform length normally equal to a line interconnecting the major and minor radii A and B only spaced apart by 60° about the center 12*a* of the cam 12. The link 30 in FIG. 1, for example, illustrates this since it has pivot connections on its opposite ends lying on a circle formed about the center 12*a* of the cam 12 having the radius A of the major diameter and lying on a circle having the radius B of the minor diameter for the cam 12.

After the portion of the cam profile 46 for the intake stroke is established, the power portion of the stroke preferably is made identical so that each diameter of this portion of the cam has a midpoint coincident with the cam 12. The compression and exhaust portions of the cycle are generated by the rollers 32 and 34 as the cam 12 rotates and the rollers 18, 31 and 33 move over the power and intake curves of the cam 12. By thus generating the cam profile for the compression and exhaust portions of the engine cycle, the rollers 18, 18*a* and 31 through 34 will all maintain contact with the cam 1 as the cam 12 is rotated through 360°.

Figure 4:
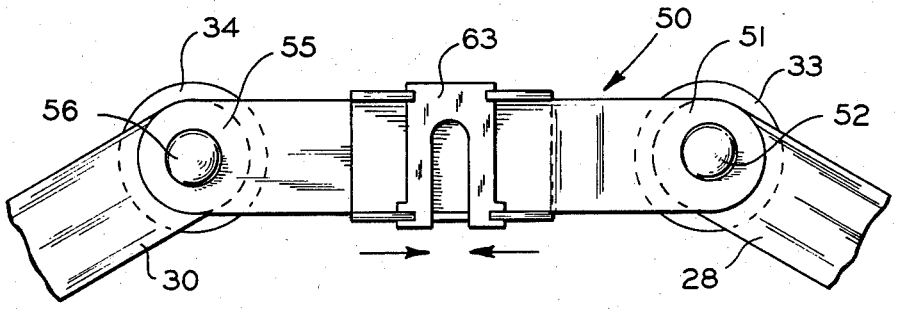
FIG. 4 is a side view of an expansion link for use in the apparatus of the present invention.
Figure 5:
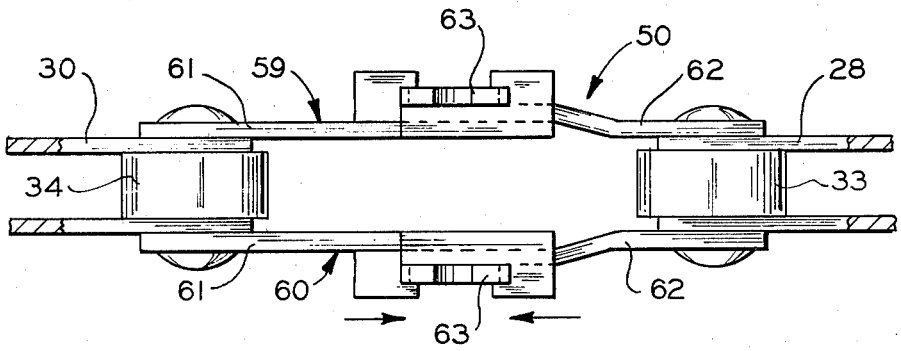
FIG. 5 is a bottom view of the link illustrated in FIG. 4.

When a cold engine is initially started and has not reached its normal operating temperature, the cam 12 and the linkages 25 through 30 may be subjected to thermal stresses for a short period of time which temporarily produce non-uniform thermal expansion of the cam 12 and/or of the linkages 25 through 30. If desired, either all of the links or the two opposed links such as the links 26 and 29, may be replaced with expandable links, such as the link 50 illustrated in FIGS. 4 and 5. When the link 50 replaces the link 29, for example, it has an end 51 connected by a pivot pin 52 to the roller 33 and also to the adjoining link 28 and 34 and to the adjoining link 30. The link 50 includes two similar, parallelly arranged expansion side members 59 and 60, each comprising an inside member 61 and an overlapping end portion, outside member 62, the overlapping ends being suitably interconnected by a tension spring 63 which resiliently prevents and limits elongation. As forces are exerted on the pins 52 and 56 tending to elongate the link 50, the ends of the overlapping portions of each member 61 and 62 of each side 59 and 60 move toward each other, as illustrated by arrows in FIG. 5, allowing the rollers 33 and 34 to move apart slightly. Thus, the link 50 will maintain the rollers in contact with the cam 12 even though there is non-uniform thermal expansion during initial warm-up of the engine. An expandable link, such as link 50, also may be used for taking up slack as the cam and the rollers wear during extended use of the engine.

As stated above, the six links are selected to extend between circles formed by the major and minor radii over a 60° segment about the center of rotation of the cam. The cam profile is selected for one portion of the operating cycle of the engine, such as the power portion, and the profile is generated by the rollers for the next portion of the cycle, such as the exhaust portion. The generated cycles may be modified slightly by making slight, equal adjustments in the length of the links 25 through 30. In each case, the portion of the cycle which is generated is selected to maintain the rollers in contact with the cam surface. In establishing the size of the cam during the initial design, the stroke, which is the differences between the major and minor radii, normally cannot exceed the minor radius, unless the length of the links are shortened. If the stroke does exceed the minor radius and the links are not shortened, two adjacent links will approach a straight line at times during the cycle and an unstable condition may result with the rollers moving out of contact with the cam. In some cases, the stroke may be selected to equal the minor radius. An unstable condition can be eliminated by slightly decreasing the lengths of the link which will in turn modify the generated portion of the cam pattern.

The above-described energy transfer apparatus 10 has several benefits over prior reciprocating piston mechanisms. By increasing the length and duration of the intake stroke, the volumetric efficiency is increased due to the greater volume and proportional time for intake and by quickly compressing the charge there is less chance for pre-ignition, spark knock, reduced thermal losses to the cylinder walls and etc. By increasing the duration of the working or power stroke, the working pressure is released over a wider angle of shaft rotation and a higher pressure is maintained over a greater portion of the power stroke. Furthermore, the piston velocity and the piston ring seal velocity is at a minimum when the pressure on the piston is the highest. Finally, the design allows for varying and selecting a desired movement of the piston in portions of the operating cycle of the engine. Still another advantage over engines of the type having a crank shaft is that the shaft 11 of the engine 10 turns at one-half the normal speed of a conventional engine shaft, thereby reducing wear on the engine. Furthermore, a more complete combustion of the fuel/air mixture and better scavenging of the cylinder is obtained.

It will be appreciated that various modifications and changes may be made in the above-described energy transfer apparatus 10 without departing from the spirit and scope of the invention. For example, the invention has been described as being embodied in a four cycle engine. The invention is equally applicable to a two cycle engine. The energy transfer apparatus 10 has been described as completely scavaging the cylinders on the exhaust stroke and as having 120° of shaft rotation for the intake and power strokes and 60° of shaft rotation for the compression and exhaust strokes. The cam may be offset for other piston displacements and modified for other shaft rotations, such as 115° rotation for the intake and power strokes and 65° rotation for the compression and exhaust strokes. Generally, it does not appear to be desirable to exceed about 135° of shaft rotation for the intake and power strokes. However, in accordance with the present invention, the power stroke will take place over greater than 90° of shaft rotation to provide an increased efficiency over prior art crank shaft type engines.

The apparatus 10 has been described as having a single cam for moving the pistons 16 and 16*a*. It should be appreciated that additional pistons may be mounted about the cam such as three pistons or six pistons, and that additional cams may be mounted on the shaft 11 for driving additional pistons. Furthermore, it should be noted that the single cam 12 may be replaced with three cams spaced along the shaft 11 with the two outer ones of the cams identical and keyed to the shaft 11 and the inner one of the cams gear driven in the opposite direction so that the three cams simultaneously engage the piston rollers 18 and 18*a* for reciprocating the pistons 16 and 16*a*. With this arrangement, no side loading forces are exerted on the pistons 16 and 16*a* or their connecting rods. As far as the linkages are concerned, an apparatus in accordance with the present invention must have at least six linkages in order to maintain proper contact between the rollers and the cam. A greater number of linkages may be provided if desired. However, the stroke of the engine must be reduced or the minor diameter must be increased when more than six linkages are used to prevent adjacent linkages from approaching an unstable straight line during rotation of the cam.

In accordance with the provisions of the patent statutes, the principles and mode of use of the invention has been explained and what is considered to represent its preferred embodiment has been illustrated and described. It should, however, be understood that the invention may be practiced otherwise than as specifically illustrated and described without departing from its spirit and scope.

What is claimed is:

1. An apparatus for transferring energy, comprising:

(a) at least two cylinders;

(b) a piston reciprocably mounted within each of said cylinders;

(c) a rotary shaft;

(d) cam means connected to said shaft for rotation therewith, said cam means having a profile defined by a major and a minor diameter having coincident centers, said coincident centers displaced from the axis of said rotary shaft, said cam profile having at least two identical profiles for reciprocating said pistons at least twice in one revolution of said shaft;

(e) follower means following the profile of said cam means, said follower means including at least six equally spaced rollers and six equal length links with adjacent rollers being interconnected by one of said links, at least two of said links being elongatable in length and including a pair interconnected members having overlapping portions movable relative to each other and a spring member coupled to the overlapping portions tending to resist elongation of said pair of interconnected members; and (f) means connecting said pistons to said follower means whereby one of said pistons is juxtaposed the top of its associated cylinder by one of said identical profiles and another of said pistons is displaced from the top of its associated cylinder by another of said identical profiles.

2. The invention defined in claim 1 wherein the center of said rotary shaft is displaced from the coincident centers of said cam means along the major diameter.

3. The invention defined in claim 1 wherein pairs of said cylinders are circumferentially spaced 180° relative to each other.

* * * * *